US008454308B2

(12) United States Patent
Itter

(10) Patent No.: US 8,454,308 B2
(45) Date of Patent: Jun. 4, 2013

(54) HORIZONTALLY SPLIT FLOW MACHINE HOUSING

(75) Inventor: Lutz Itter, Wuppertal (DE)

(73) Assignee: MAN Diesel & Turbo SE, Augsburg (DE)

( * ) Notice: Subject to any disclaimer, the term of this patent is extended or adjusted under 35 U.S.C. 154(b) by 723 days.

(21) Appl. No.: 12/629,116

(22) Filed: Dec. 2, 2009

(65) Prior Publication Data

US 2010/0143113 A1 Jun. 10, 2010

(30) Foreign Application Priority Data

Dec. 5, 2008 (DE) ..... 10 2008 060 705

(51) Int. Cl.
*F01D 25/24* (2006.01)

(52) U.S. Cl.
USPC ..... 415/209.2

(58) Field of Classification Search
USPC ..... 415/213.1, 214.1, 215.1, 209.2
See application file for complete search history.

(56) References Cited

U.S. PATENT DOCUMENTS

| | | | | |
|---|---|---|---|---|
| 1,242,578 | A * | 10/1917 | Moore | 415/209.2 |
| 1,362,437 | A | 12/1920 | Robb | |
| 1,692,537 | A | 6/1924 | Baumann | |
| 1,873,743 | A * | 8/1932 | Doran | 415/213.1 |
| 3,628,884 | A | 12/1971 | Mierley | |
| 3,861,827 | A | 1/1975 | Peabody et al. | |
| 3,947,150 | A | 3/1976 | Lohonen | |
| 4,957,412 | A * | 9/1990 | Olson et al. | 415/208.2 |
| 6,224,332 | B1 | 5/2001 | Leach et al. | |

FOREIGN PATENT DOCUMENTS

| | | |
|---|---|---|
| GB | 542197 | 12/1941 |
| GB | 2 339 859 | 2/2000 |
| JP | 61223300 A * | 10/1986 |

* cited by examiner

*Primary Examiner* — Richard Edgar
(74) *Attorney, Agent, or Firm* — Cozen O'Connor

(57) ABSTRACT

A horizontally split flow machine housing, particularly for a radial compressor, has a top housing part and a bottom housing part and a top stator part which is received in the top housing part and is prevented from falling out in that the top stator part is supported from the top by stator stops on housing stops. At least one housing stop is fastened to the top housing part in such a way that it can be adjusted toward a stator stop during assembly and is supported at the top housing part below a point of contact between the stator stop and housing stop.

19 Claims, 1 Drawing Sheet

HORIZONTALLY SPLIT FLOW MACHINE HOUSING

BACKGROUND OF THE INVENTION

1. Field of the Invention

The invention is directed to a horizontally split flow machine housing and to a method for assembling a flow machine housing of this kind.

2. Description of the Related Art

Horizontally split flow machine housings have at least one top housing part and one bottom housing part which are connected to one another in a horizontal butt joint allowing elements of the flow machine to be arranged in the open housing parts when the top housing part is lifted off. In particular, in flow machines, which are divided in the horizontal plane of a rotor shaft, a rotor of the flow machine can first be inserted into the bottom housing part and the top housing part can then be placed on top. In the present case, such words as "horizontal", "vertical", "top", "bottom" always refer to the final assembly position in which the flow machine is set up.

Generally, a number of stator elements are arranged in the housing parts. In radial compressors with horizontal joints a plurality of stator rings are arranged one behind the other in axial direction in a housing and, together with the rotor blades, define the flow channel for the fluid to be compressed and radially deflect this fluid between two repeater stages.

To insert a rotor of the flow machine, stator elements of the kind mentioned above comprise at least a top stator part and a bottom stator part formed as split stator rings.

To facilitate assembly, the top stator parts are first inserted into the housing part that is rotated around its longitudinal axis by 180° relative to its final assembly position, i.e., is open toward the top, and then rotated together with the latter by 180° into the final assembly position and placed on the correspondingly preassembled bottom housing part, the top stator parts must in all cases be prevented from falling out during their rotation and placement on top of the bottom housing part.

It is known, for example, from U.S. Pat. Nos. 1,692,537 and 3,628,884 to secure a top stator part of an axial turbine with a horizontally split housing in a top housing part by means of screws which are screwed into the top stator part from the top and which pull the top stator part against the top housing part.

British Patent GB 542,197 discloses a horizontally split turbine housing in which top stator ring halves are prevented from falling out by brackets that engage in cutouts in the stator ring halves and are screwed to the top housing part by bolts.

U.S. Pat. No. 3,947,150 suggests mounting a top stator part in a pin of the top housing part and supporting it by swiveling an eccentric wedge in the stator part relative to another pin in the top housing part.

In all cases, the screws are subjected to complex tensile and bending loads that make them difficult to design and that complicates assembly and disassembly.

SUMMARY OF THE INVENTION

An object of the present invention is to provide a housing for a flow machine, particularly for a radial compressor.

A horizontally split flow machine housing according to one embodiment of the invention, particularly a housing of a radial compressor, comprises at least a top housing part and a bottom housing part as well as a top stator part which is received in the top housing part. A bottom stator part is preferably received in the bottom housing part.

In particular, the top housing part and bottom housing part can be parts of an inner or outer housing of the flow machine. The partition line between the top and bottom housing parts and/or stator parts is preferably located in the horizontal plane of the longitudinal axis of a rotor of the flow machine and accordingly allows the rotor to be inserted into the bottom housing part, whereupon the preassembled top housing part can be placed on top. However, dividing joints are conceivably also provided in other horizontal planes, particularly for maintenance purposes.

The top and/or bottom stator part can be constructed as a ring-half and can define a flow channel of the flow machine, for example, a return channel between two rotor stages. Similarly, the top stator part can also be a top inner housing part of one or more flow machine stages which is received in turn in a top outer housing part a housing of a compressor side of a double-flow radial compressor, or the like.

When assembling, the top stator part is preferably first inserted into the top housing part which is rotated around its longitudinal axis by 180° relative to its final assembly position, i.e., is open toward the top, and the top stator part is then rotated together with the latter by 180° into the final assembly position and placed on the correspondingly preassembled bottom housing part.

For this purpose, the top stator part is supported from the top with stator stops on housing stops to prevent it from falling out during assembly when the top housing part is rotated into its final assembly position, i.e., open at the bottom.

The stator stops are preferably formed as cutouts on sides of the top stator part which are located opposite to one another in horizontal direction. Cutouts of this kind can be produced simply and precisely by machining with a milling cutter.

According to one embodiment of the invention, one or more, particularly two, housing stops are fastened to the top housing part in such a way that they can be adjusted toward the respective stator stop during assembly. To this end, an adjustable housing stop can comprise a screw. An adjustable housing stop can be formed by a threaded pin which is screwed into a screw channel of the top housing part and can be adjusted toward the respective stator stop during assembly by turning it. Adjustment is still possible after assembly, preferably to facilitate disassembly. Similarly, the housing stop can also be secured by screws, after assembly. However, an adjustable housing stop can also be formed by a dowel pin which can be adjusted toward the respective stator stop by driving it into a bore hole in the top housing part.

Since the top stator part is supported on housing stops from the top by its stator stops during assembly, at least one housing stop is adjustably received in the top housing part so that the stator part can initially be inserted into the housing part when the housing stop is retracted and then prevented from falling out counter to the insertion direction by adjusting this housing stop toward the stator stop. An opposite housing stop is also adjustable, preferably in a structurally identical manner, toward the stator stop associated with it. In an advantageous construction, it is possible to align the top stator part in the top housing part by adjusting the two housing stops on which the stator part is supported and facilitates insertion of the top stator part when the two housing stops are retracted. Similarly, an opposite housing stop can also be fixedly connected to the top housing part or formed integral with it because it is still possible to insert the stator part when only one housing stop is adjustable.

After assembly, the top stator part can continue to be supported with its stator stops on the housing stops. In addition or alternatively, it can also be supported on a bottom stator part or housing part by one of its joint faces so that the housing stops are relieved when the top housing part and bottom housing part are put together. So as not to impede further assembly, one or more adjustable housing stops terminate flush with the joint of the top housing part or are recessed therein in the final assembly position.

According to one embodiment of the invention, the at least one adjustable housing stop is supported at the top housing part below a point of contact between the stator stop and housing stop with respect to the final assembly position, i.e., with the joint face of the top housing part at the bottom, so that the housing stops are subjected substantially to compressive loading. A predominantly compressive loading of this kind is more manageable, particularly with respect to design. In an advantageous construction, it also allows the use of adjustable housing stops with smaller diameters, i.e., smaller bore holes in the top housing part.

The proposed compressive loading makes it possible to place the stator stops loosely upon the housing stops so that there is no need for a tension-resistant connection to the top stator part; in particular, there is no need to form bore holes which are aligned with bore holes in the top housing part and which are complicated to produce. In particular, the loose support also results in a certain amount of play of the stator part in the housing part and avoids tensile loading with a correspondingly complex stress state in the housing stop.

One or more housing stops, preferably all of the housing stops, are substantially subjected to compressive loading. For this reason, a certain bending stress perpendicular to the adjusting direction of the housing stop should to a component of the force exerted by the top stator part on the housing stop must not be ruled out. For example, when the top stator part is supported on both sides on two threaded pins in the top housing part which are preferably at an inclination of 45°, these threaded pins are subjected to a compressive force $F_D$ in the longitudinal direction of the thread of $$F_D = \frac{1}{2} \cdot m \cdot g \cdot \cos\alpha = \frac{1}{\sqrt{2}} \cdot m \cdot g$$

and a shear force $F_Q$ perpendicular thereto of $$F_Q = \frac{1}{2} \cdot m \cdot g \cdot \sin\alpha = \frac{1}{\sqrt{2}} \cdot m \cdot g,$$

where m is the mass of the top stator part, g is the acceleration due to gravity, and $\alpha$ is the angle of inclination relative to the vertical line. In this case, the component $F_D$ in the adjusting direction is quantitatively identical to the component $F_Q$ perpendicular to the adjusting direction.

In adjusting directions at an acute angle to the vertical line, the ratio of compressive force to shear force increases accordingly, for example, at an angle of 30° to:

$$\frac{F_D}{F_Q} = \frac{\cos\alpha}{\sin\alpha} = \sqrt{3}.$$

During assembly, one or more adjustable housing stops are preferably adjustable parallel to a partition line between the top and bottom housing part and, at the same time, in a perpendicular direction away from the partition line as explained in connection with the example of the threaded pins that are guided diagonally in meridional section. In the same way, an advancing adjusting movement in horizontal direction can be realized which pushes the housing stop under the inserted stator stop so that the latter is supported on the adjusted housing stop from the top, and an alignment of the stator part in vertical direction can be realized accompanied at the same time by a desirable distribution of compressive forces and shear forces.

The top stator part is preferably received in a groove in the top housing part and is accordingly secured in axial direction on one or both sides. Accordingly, in conjunction with its support on the housing stops, the stator part is securely guided during assembly.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Further advantages and features are indicated in the subclaims and in the embodiment examples. In a partially schematic manner, the drawings show:

DETAILED DESCRIPTION OF THE PRESENTLY PREFERRED EMBODIMENTS

Figure 1:
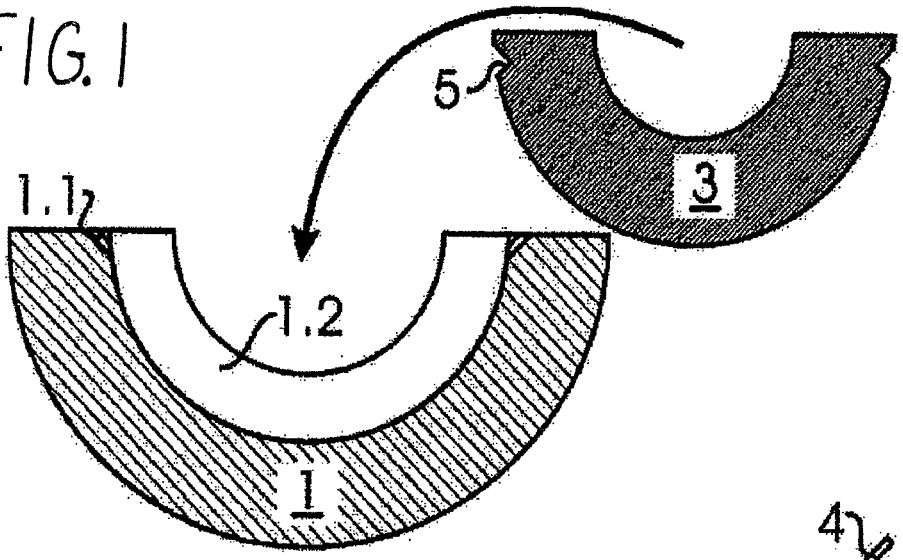
FIG. 1 is a top housing part and a top stator part of a flow machine housing according to a construction of the present invention in meridional section before the top stator part is received in the top housing part.
Figure 2:
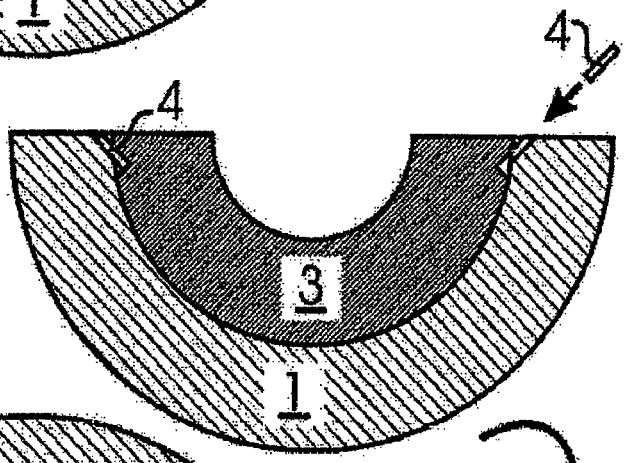
FIG. 2 is the top housing part and stator part according to FIG. 1 when a housing stop is adjusted toward a stator stop.
Figure 3:
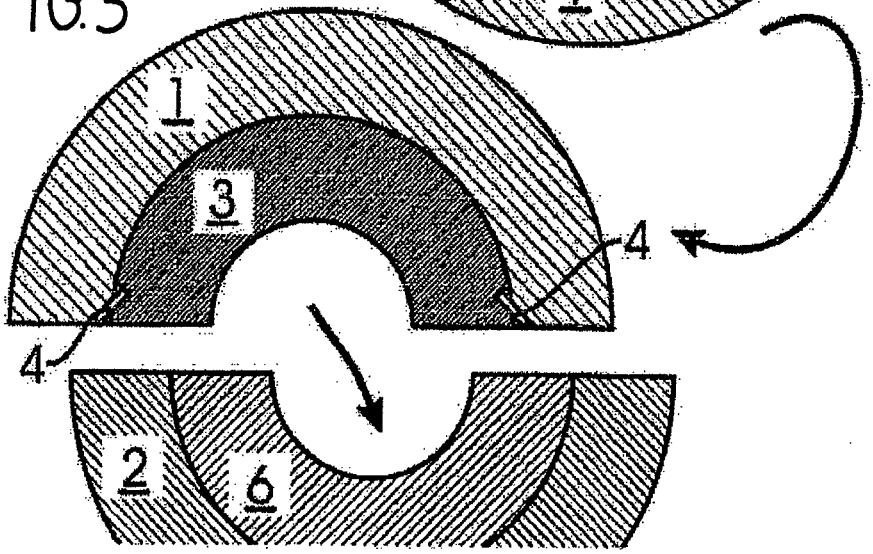
FIG. 3 is the top housing part and stator part according to FIG. 1 after rotating by 180° into the final assembly position prior to connecting to a bottom housing part with the stator part received therein.

The sequence of schematic drawings from FIG. 1 to FIG. 2 to FIG. 3 shows the assembly of a housing of a radial compressor according to an embodiment of the present invention. For assembly, a top housing part 1 is moved into a position in which it is rotated by 180° around its longitudinal axis with respect to a final assembly position so that its joint face is on top, i.e., the top housing part 1 opens upward.

In a first step, a top stator part 3, in the form of a ring-half, is inserted from the top into a groove 1.2 of the top housing part 1 as is indicated in FIG. 1 by an arrow. On opposite sides (left and right in FIG. 1) in horizontal direction, it has stator stops which are preferably formed as milled flats 5 in the top stator part 3.

When the ring-half 3 is inserted into the top housing part 1, these milled flats 5 lie across from bore holes 1.1 in the top housing part 1 (see FIG. 1) so that set screws 4 (see FIG. 2) are screwed into the top housing part 1 from the joint face of the top housing part 1 and partially project into the annular groove 1.2 contacting the milled flats 5 as housing stops. The ring-half 3 can be aligned in the groove 1.2 by adjusting the two set screws 4 in the bore holes 1.1 of the housing part 1.

In a modification which is not shown in the drawings, only the housing stop on the right-hand side in FIG. 2 is constructed so as to be adjustable as a set screw 4. The housing stop on the left-hand side is formed integral, with the top housing part and has the approximate shape of the set screw 4 and projects into the annular groove 1.2. The top stator part 3, whose milled flats on the left-hand side referring to FIG. 1 extends to the joint face of the top stator part 3 in this embodiment can then be inserted into the groove 1.2 from the right-hand side while simultaneously being rotated and can be turned in this groove 1.2 until the milled flat comes into contact with the stationary housing stop on the left-hand side. By screwing in the set screw 4 on the right-hand side, the top stator part is again prevented from falling out.

The top housing part 1 together with the ring-half 3 received in its groove 1.2, can be rotated by 180° into its final assembly position (FIG. 2 to FIG. 3). The ring-half 3 is supported by its milled flats 5 from the top on the set screws 4 which are supported in turn below a point of contact between the milled flat 5 and set screw 4 in the bore hole 1.1 in the top housing part 1 when the top housing part 1 is rotated into its final assembly position. The milled flats 5 are loosely supported on the set screws 4 so that they subjected to a compressive load.

The top housing part 1 which is preassembled in this way is then placed on a corresponding bottom housing part 2 in which a bottom stator part in the form of a bottom ring-half 6 is received and is connected to the latter. In this state, the top stator ring-half 3 is supported with its horizontal joint on the bottom stator part 6 to form a fluid-tight butt joint. In so doing, the set screws 4 are relieved, and the milled flats 5 are lifted slightly away from them. A clearance that is required for this purpose can be adjusted in a simple manner by screwing in or unscrewing the set screws 4 in the bore holes 1.1.

The set screws 4 which are substantially subjected to compressive loading according to the invention can advantageously be constructed so as to be smaller and more precisely designed than in known solutions in which screws are subjected to complex tensile and flexural loading.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A flow machine housing configured as a horizontally split flow machine housing, comprising:

a top housing part, the top housing part comprising at least two housing stops;

a bottom housing part configured to mate with the top housing part; and a top stator part configured to be received in the top housing part, the top stator part comprising at least two stator stops configured to mate with respective housing stops to fix the top stator part to the top housing part wherein at least one of the two housing stops is adjustably fastened to the top housing part such that it is adjustable toward a respective stator stop and is supported at the top housing part below a point of contact between the stator stop and housing stop wherein the at least one adjustable housing stop extends diagonally from a partition line between the top housing part and the bottom housing part and adjustable in a direction towards the respective stator stop.

2. The flow machine housing according to claim 1, wherein the adjustable housing stop comprises a screw.

3. The flow machine housing according to claim 2, wherein the adjustable housing stop is a threaded pin.

4. The flow machine housing according to claim 1, wherein at least one stator stop is a cutout.

5. The flow machine housing according to claim 4, wherein at least one stator stop is a milled flat.

6. The flow machine housing according to claim 1, wherein the top stator part is supported on the housing stops such that the housing stops are subjected to compressive loading.

7. The flow machine housing according to claim 6, wherein a component of the force exerted by the top stator part on a housing stop in its adjusting direction is at least equal to a component perpendicular to the adjusting direction.

8. The flow machine housing according to claim 7, wherein a component of the force exerted by the top stator part on a housing stop in its adjusting direction is at least $\sqrt{3}$-times the component perpendicular to the adjusting direction.

9. The flow machine housing according to claim 1, wherein the at least one stator stop is loosely supported on the respective housing stop.

10. The flow machine housing according to claim 1, wherein the at least two stator stops are formed on opposite sides of the top stator part.

11. The flow machine housing according to claim 1, wherein the top stator part is substantially shaped as a partial ring.

12. The flow machine housing according to claim 1, wherein the top stator part defines a flow channel of the flow machine.

13. The flow machine housing according to claim 1, wherein the top stator part is received in a groove of the top housing part and is secured in axial direction.

14. The flow machine housing according to claim 13, wherein the at least one housing stop projects at least partially into the groove in the final assembly position.

15. The flow machine housing according to claim 1, wherein the top housing part and the top stator part have joint faces that are flush with one another in the final assembly position.

16. The flow machine housing according to claim 1, wherein the adjustable housing stops one of:

terminate flush with a joint face of the top housing part in a final assembly position and terminate recessed from the joint face of the top housing in the final assembly position.

17. The flow machine housing according to claim 1, wherein the flow machine is a radial compressor.

18. The flow machine housing according to claim 1, wherein the top stator part is a half-ring.

19. A method for assembling a flow machine housing comprising:

receiving a top stator part having a stator stop in a top housing part, the top housing part having at least one adjustable housing stop;

adjusting the at least one housing stop toward the stator stop; and connecting the top housing part and a bottom housing part to one another, wherein the at least one adjustable housing stop extends diagonally from a partition line between the top housing part and the bottom housing part and is adjustable in a direction towards the stator stop.

* * * * *